US007473065B2

(12) United States Patent
Wells

(10) Patent No.: US 7,473,065 B2
(45) Date of Patent: Jan. 6, 2009

(54) OILFIELD PIPE-HANDLING APPARATUS

(76) Inventor: Kerry Wells, P.O. Box 176, Marsden, Saskatchewan (CA) S0M 1P0

( * ) Notice: Subject to any disclaimer, the term of this patent is extended or adjusted under 35 U.S.C. 154(b) by 193 days.

(21) Appl. No.: 11/155,560

(22) Filed: Jun. 20, 2005

(65) Prior Publication Data

US 2006/0045655 A1 Mar. 2, 2006

(30) Foreign Application Priority Data

Jun. 25, 2004 (CA) ..... 2472387

(51) Int. Cl.
*E21B 19/00* (2006.01)
*B66F 11/00* (2006.01)

(52) U.S. Cl. ..... 414/22.57; 414/546; 414/743; 414/746.5

(58) Field of Classification Search ..... 175/52; 89/1.815; 414/22.61, 745.9, 22.54–22.62, 414/746.5

See application file for complete search history.

(56) References Cited

U.S. PATENT DOCUMENTS

| | | | | |
|---|---|---|---|---|
| 2,631,741 | A | 3/1953 | Tucker | |
| 2,656,052 | A | 10/1953 | Tucker | |
| 3,053,401 | A | 9/1962 | Jinkins, Jr. | |
| 3,559,821 | A | 2/1971 | James | |
| 3,706,347 | A | 12/1972 | Brown | |
| 3,780,883 | A | 12/1973 | Brown | |
| 3,792,783 | A | 2/1974 | Brown | |
| RE28,071 | E * | 7/1974 | Smart | 414/746.8 |
| 4,347,028 | A | 8/1982 | Dugan | |
| 4,386,883 | A * | 6/1983 | Hogan et al. | 414/22.61 |
| 4,552,498 | A | 11/1985 | Dysarz | |
| 5,122,023 | A | 6/1992 | Mochizuki | |
| 6,079,925 | A | 6/2000 | Morgan et al. | |
| 6,179,065 | B1 * | 1/2001 | Payne et al. | 175/24 |
| 6,533,519 | B1 | 3/2003 | Tolmon et al. | |
| 6,899,510 | B2 | 5/2005 | Morelli et al. | |
| 2003/0123955 | A1 | 7/2003 | Eastcott | |
| 2003/0147726 | A1 | 8/2003 | Tolmon et al. | |
| 2003/0170095 | A1 * | 9/2003 | Slettedal | 414/22.59 |
| 2004/0208730 | A1 | 10/2004 | Morelli et al. | |

FOREIGN PATENT DOCUMENTS

| | | |
|---|---|---|
| CA | 2224638 | 2/2004 |
| WO | WO 01/42618 A1 | 6/2001 |

* cited by examiner

*Primary Examiner*—Gregory W Adams
(74) *Attorney, Agent, or Firm*—Donald V. Tomkins

(57) ABSTRACT

A trailer-mounted pipe-handling apparatus has an elongate cradle swivelable about a longitudinal swivel axis for loading or offloading pipe at a well site. With the cradle horizontal, and swiveled into a loading position, loading arms receive a pipe from a loading rack, whereupon kicker members move the pipe from the loading arms into the cradle. With the cradle swiveled into a neutral position supporting the pipe, a swing arm raises one end of the cradle while simultaneously drawing its other end horizontally along a base track, thus placing the cradle in a tilted configuration. The raised end of the pipe can thus be positioned above the floor of a drilling rig or service rig for connection to the rig hoist, which can then lift the pipe out of the cradle. Pipe may be removed from the well using a similar, reverse procedure. The rig hoist positions a removed pipe in the tiltingly elevated cradle, which is then lowered to the horizontal position. The cradle is then swiveled to an offloading position, allowing the pipe to roll out of the cradle onto an offload rack.

19 Claims, 16 Drawing Sheets

PE
RF
R
P
P1
46
44
42
X1
20
21
30
18
14
12
43
45
11
60
62

PE
RF
R
P
P1
20
30
X1
18
14
12
44
45
43
62
60
11

R
PE
RF
P
P1
44
20
30
X1
18
14
12
42
45
43
62
60
11

R
PE
RF
P
P2
42
P1
20
30
X1
18
14
12
44
43
45
62
60
11

PE
RF
30
X1
20
P1
18
14
12
62
43
42
44
46
P2
45
P
60
R

PE
RF
30
20
P1
12
18
14
43
42
44
P2
45
P
R
62
60
11

R
PE
RF
P
P2
P1
30
20
42
44
45
43
18
14
12
62
60
11

PE
RF
R
P
42
44
45
11
60
30
20
P1
18
14
12
43
62

OILFIELD PIPE-HANDLING APPARATUS

FIELD OF THE INVENTION

The present invention relates in general to apparatus for transporting oilfield tubulars between a tubular storage area and the floor of a drilling rig or service rig during well drilling or servicing operations.

BACKGROUND OF THE INVENTION

Drill pipe and production tubing for oil and gas wells are typically provided in the form of round steel pipe (commonly referred to as tubulars), typically in sections (or "joints") about 30 feet in length, with threaded ends for connecting tubulars into a drill string or a production string, depending on the operation being conducted. The term "make-up" is commonly used to refer to the process of connecting tubulars to each other (i.e., "making up" a threaded connection), and the term "break-out" refers to the process of disconnecting tubulars (i.e., "breaking out" a threaded connection). Well drilling and well servicing involve both make-up and break-out functions, for a variety of purposes well known in the field. During make-up operations, sections of drill pipe or production tubing must be transported from a pipe storage rack of some sort to the rig floor for connection to the string already in the well bore. During break-out operations, the pipe sections must be transported from the rig floor to the pipe rack after they have been disconnected from the string.

Apparatus for handling tubulars during such field operations typically feature a hoisting mechanism that receives a section of pipe from a pipe rack (typically horizontal) positioned close to the drilling rig or service rig (as the case may be). The hoisting mechanism then lifts one end of the pipe and moves it laterally toward and above the rig floor, so that it can be engaged by the rig hoist, which moves the pipe into position for connection to the string of pipe in the well bore. This procedure is reversed during break-out operations. As each pipe section is disconnected from the string, it is lifted by the rig hoist, and workers manouever the lower end of the pipe laterally toward the hoisting mechanism of the pipe-handling apparatus. The rig hoist lowers the pipe onto the hoisting mechanism of the pipe-handling apparatus, which in turn moves the pipe laterally away from the rig, while at the same time restoring the pipe to a horizontal orientation, whereupon it is moved to a horizontal storage rack.

The prior art discloses numerous examples of apparatus for handling tubulars and transporting them to and from pipe storage facilities positioned near a drilling rig or service rig. Canadian Patent No. 2,224,638, issued to Handley et al. on Feb. 24, 2004, describes a horizontal pipe storage rack with an elongate pipe cradle having a shallow V-shaped trough for cradling a tubular. With a tubular thus "loaded" on the apparatus, the far end of the pipe cradle (i.e., the end farthest from the rig floor) is moved laterally toward the rig, and by virtue of one of several alternative mechanical arrangements, this lateral movement has the effect of simultaneously raising the inward end of the pipe cradle, and thus the inward end of the tubular, above the rig floor level so that it can be readily engaged by pipe elevators manipulated by rig floor workers.

The reverse procedure is followed when breaking out a drill string or production string. The Handley apparatus also provides means for rotating the pipe cradle about its longitudinal axis when it is lying in the plane of the pipe rack, so that a tubular cradled in the trough of the pipe cradle after being pulled from the well bore will roll out of the trough and into the rack by gravity.

Additional examples of prior art pipe-handling apparatus are disclosed in the following references:

- U.S. Pat. No. 2,631,741 (Tucker), issued Mar. 17, 1950
- U.S. Pat. No. 2,656,052 (Tucker), issued Oct. 20, 1953
- U.S. Pat. No. 3,053,401 (Jinkins, Jr.), issued Sep. 11, 1962
- U.S. Pat. No. 3,559,821 (James), issued Feb. 2, 1971
- U.S. Pat. No. 3,706,347 (Brown), issued Dec. 19, 1972
- U.S. Pat. No. 3,780,883 (Brown), issued Dec. 25, 1973
- U.S. Pat. No. 3,792,783 (Brown), issued Feb. 19, 1974
- U.S. Pat. No. 4,347,028 (Dugan), issued Aug. 31, 1982
- U.S. Pat. No. 2,631,741 (Tucker), issued Jun. 29, 1950
- U.S. Pat. No. 4,386,883 (Hogan), issued Jun. 7, 1983
- U.S. Pat. No. 4,552,498 (Dysarz), issued Nov. 12, 1985
- U.S. Pat. No. 5,122,023 (Mochizuki), issued Jun. 16, 1992
- U.S. Pat. No. 6,069,925 (Morgan et al.), issued Jun. 27, 2000
- U.S. Pat. No. 6,533,519 (Tolmon et al.), issued Mar. 18, 2003
- U.S. patent application Ser. No. 10/279,453 (Eastcott), filed Oct. 23, 2002
- Int. Application No. PCT/DE00/03903 (Borgeling), filed Nov. 7, 2000

Although each of these examples of prior art pipe-handling apparatus may have beneficial operational features, there remains a need for pipe-handling apparatus that can perform the required pipe-handling functions with increased efficiency as compared with prior art apparatus. In addition, there is a need for apparatus that can perform these functions while having less mechanical complexity that the prior art apparatus. The present invention is directed to these needs.

BRIEF SUMMARY OF THE INVENTION

In general terms, the present invention is an oilfield pipe-handling apparatus for use in association with a pipe storage rack positioned adjacent to a drilling rig or service rig. The apparatus has an elongate pipe cradle with a trough for receiving and supporting a section of pipe, such as drill pipe or production tubing. In the preferred embodiment, the trough is V-shaped, and this configuration is conveniently achieved by fashioning the cradle from two steel plates or from a standard structural steel angle section. Alternatively, the cradle may be fashioned with a trough that is convexly curvilinear in cross-section.

The apparatus includes an elongate base structure with a horizontal base track having an inward end and an outward end. Preferably, the base structure is mounted on a trailer chassis for ease of transport. When the apparatus is being used in association with a drilling rig or service rig, it is positioned substantially perpendicular to the rig with the inward end of the base structure adjacent to the rig and the outward end farthest from the rig. Also included in the apparatus is a track carriage that can freely move longitudinally along the base track. The track carriage may be slidable within the base track. In an alternative embodiment, the track carriage may have rolling means (such as wheels or rollers) such that the track carriage moves in rolling fashion along or inside the base track.

The outward end of the pipe cradle is mounted to the track carriage such that it is swivelable about a longitudinal swivel axis parallel to the cradle, while at the same time being rotatable, in a lengthwise sense, about a horizontal axis transverse to the track. The purpose of this bi-directionally rotatable mounting of the pipe cradle to the track carriage will become clear as the structure and operation of the apparatus are further explained herein.

The apparatus also includes lift means disposed between the base structure and the pipe cradle. More specifically, the lift means is adapted to raise the inward end of the pipe cradle from a horizontal position to an elevated position, while also causing longitudinally inward displacement of the cradle. In one embodiment of the apparatus, this is accomplished by providing lift means in the form of a swing arm rotatably mounted at one end (designated the lower end) to the base structure near the inward end thereof, so as to be rotatable about a horizontal axis transverse to the base track. The other end (i.e., upper end) of the swing arm is mounted in bi-directionally rotatable fashion to the other end to the pipe cradle. That is to say, the swing arm is rotatable relative to the pipe cradle about a horizontal axis parallel to the rotational axis of the lower end of the swing arm, while the cradle is swivelable relative to the upper end of the swing arm about the aforesaid swivel axis.

The swing arm's point of connection to the cradle is located so as to lie outward of the connection to the base structure when the cradle is in the horizontal position. When the swing arm is rotated upward and toward the rig, the geometry of the swing arm assembly raises the inward end of the cradle while at the same time causing the track carriage, and thus the outward end of the cradle, to move inward toward the rig.

The swing arm may be provided in the form of a single member, or it may be in the form of a frame having multiple structural components, or in any other suitable structural configuration. The swing arm may be actuated by one or more hydraulic rams mounted to the base structure and connected to the swing arm so as to create a third-class lever configuration. However, other suitable actuation means, including electrically-actuated and pneumatically-actuated mechanisms, will be readily apparent to persons skilled in the art of the invention.

In the preferred embodiment, the swing arm is telescoping or otherwise selectively variable in length. This configuration facilitates adjustment of the height of the inward end of the pipe cradle when in the elevated position, so as to optimize rig floor workers' access to the cradle and to a pipe carried by the cradle. In the preferred embodiment, extension or shortening of the swing arm is effected by way of an additional hydraulic ram, but persons skilled in the art will appreciate that other effective means of adjusting swing arm length may be devised without departing from the principles of the present invention.

Also in the preferred embodiment, the invention incorporates features that facilitate loading pipe into the pipe cradle from a loading rack positioned adjacent to one side of the apparatus, and for offloading pipe from the cradle to an off-load rack positioned adjacent to the other side of the apparatus. By virtue of the pipe cradle's bi-directionally rotatable connections to the swing arm and the track carriage, the pipe cradle is swivelable in either direction about the aforementioned swivel axis when the cradle is in a horizontal position parallel to the base structure. Accordingly, the preferred embodiment of the invention features swivel means for selectively orienting the pipe cradle in:

(a) a loading position, in which the pipe cradle is tilted toward the loading rack such that a pipe section from the loading rack can be readily moved into the trough of the cradle;

(b) a neutral position; and (c) an offloading position, in which the pipe cradle is tilted toward the offload rack such that a pipe section held by the cradle will tend to roll out of the trough by gravity onto the offload rack.

In the preferred embodiment, the swivel means comprises:

(a) a cradle sprocket mounted to and below the pipe cradle, said cradle sprocket having a circular gear section concentric with the swivel axis;

(b) a drive unit mounted below the pipe cradle, said drive unit having a rotatable drive shaft with an axis substantially parallel to the cradle;

(c) a drive sprocket mounted to the drive shaft; and (d) a discontinuous drive chain disposed around the drive sprocket and connected at each end to the cradle sprocket such that rotation of the drive shaft will cause the pipe cradle to swivel about the swivel axis.

In the preferred embodiment, the drive unit is hydraulically actuated. However, it will be readily appreciated that the apparatus could alternatively use an electrically-actuated or pneumatically-actuated drive unit.

The swivel means preferably incorporates lock-out means to prevent the cradle from being moved into either the loading or offloading position except when the cradle is in its lowered, horizontal position. In embodiments where the drive unit is hydraulically actuated, the lock-out means may be provided by way of a valving arrangement whereby the pressure to both sides of the motor is locked when the cradle is in the neutral position and cannot be released until a separate valve is opened to release the pressure to one side or the other, so as to allow the cradle to be pivoted to the loading position or the offloading position. Suitable valving arrangements may be readily devised by persons skilled in the art of the invention, using well known technology and principles.

Suitable alternative swivel means may be readily devised by persons skilled in the art using known technology, without departing from the basic concept of the present invention.

Also in the preferred embodiment, the invention includes cradle-loading means, for receiving a pipe section from the loading rack and loading it into the pipe cradle. In one embodiment, the cradle-loading means comprises two or more pipe-loading arms oriented transversely and adjacent to the pipe cradle, with each pipe-loading arm having an upwardly-disposed notch adapted to receive a pipe section from the loading rack, such that the pipe section rests in and spans between the notches of the pipe-loading arms, with the pipe section adjacent to and substantially parallel to the pipe cradle. The pipe-loading arms are operable between a lower position in which a pipe section can roll by gravity from the loading rack into the notches of the pipe-loading arms, and a slightly raised, "pre-load" position in which the pipe section remains supported in the notches, with the outboard ends of the pipe-loading arms acting as stop members to prevent other pipe sections from rolling toward the cradle.

The cradle-loading means also includes two or more kicker members, adapted to displace a pipe section supported by the pipe-loading arms laterally toward the pipe cradle. The kicker members are operable between a stowed position, in which they cannot interfere with a pipe rolling off the loading rack into the notches of the pipe-loading arms, and a deployed position in which they push or otherwise urge the pipe section out of the notches of the pipe-loading arms and into the pipe cradle.

In the preferred embodiment, the kicker members are simple arms that rotate about an axis parallel to the pipe cradle. In an alternative embodiment, the kicker members act in a reciprocating or straight-line mode to push the pipe section into the cradle.

To load a pipe into the cradle from the loading rack, the pipe-loading arms are initially disposed in their lower positions and the kicker members in their stowed positions, such that a pipe section can roll into the notches of the pipe-loading arms by gravity. The pipe-loading arms are then moved to their raised positions, and then the kicker members are actuated to push the pipe out of the notches and into the trough of the cradle, which will have been swivelled into its loading position. The cradle is then swivelled to its neutral position, whereupon the swing arm may be actuated, thus raising the inward end of the cradle upward and toward the rig floor, thus positioning the inward end of the pipe such that it may be conveniently manipulated by rig floor workers for engagement with pipe elevators associated with the rig. The rig hoist then lifts the pipe, the outward (or lower) end of which slides upward along the now-inclined cradle until it is free of the cradle. The swing arm may be lowered any time after the pipe has been connected to the pipe elevators, thus returning the cradle to its horizontal position adjacent to the loading ramp, ready to load another pipe section.

When a drill string or production string is being broken out, the procedure is reversed. The swing arm is raised so as to position the inward end of the cradle near the rig floor. Workers on the rig floor may then manipulate the lower end of a pipe section suspended by the rig hoist (after having been broken out of the string) into the elevated and inclined pipe cradle. The rig hoist then lowers the pipe, causing it to slide down along the cradle until the inward (or upper) end of the pipe can be disengaged from the pipe elevators and the pipe rests securely in the cradle. The swing arm is then lowered, thus returning the cradle to its horizontal position, whereupon the cradle may be swivelled to the offloading position such that the pipe section rolls out of the trough of the cradle and onto the offload rack.

In alternative embodiments, the cradle-loading means comprises two or more loading arms that adapted to receive a pipe from the loading rack (such as by being provided with notches as in the pipe-loading arms described previously), and operable between a lower position (for receiving a pipe from the loading rack) and a deployed preload position in which the loading arms urge the pipe into the pipe cradle. In other words, the loading arms of this alternative embodiment perform the functions of both the pipe-loading arms and the kickers described above. In this embodiment, separate stopper means of any suitable construction will be provided to prevent other pipe sections from rolling off the loading rack toward the cradle when the loading arms are being deployed to load the pipe into the cradle.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
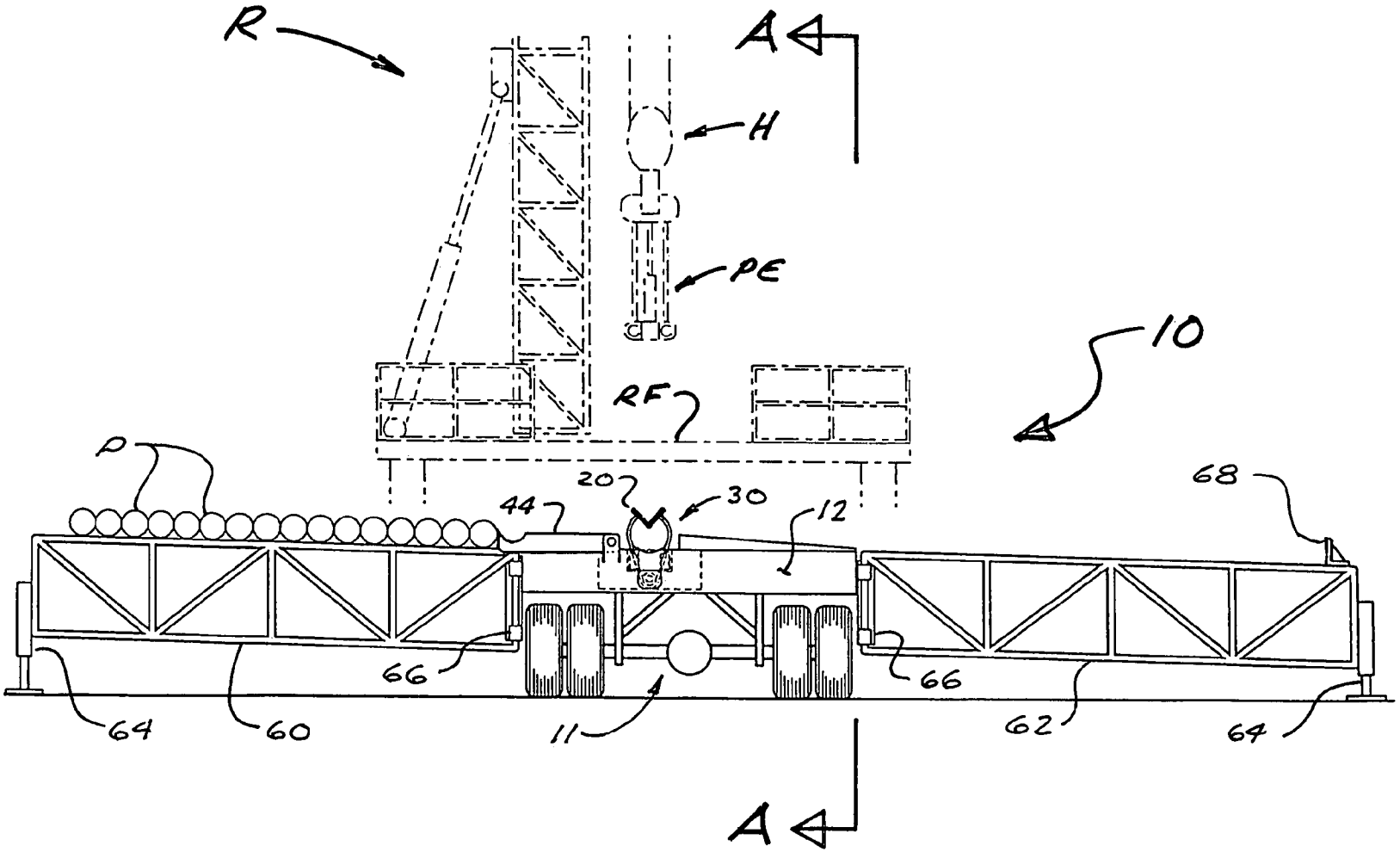
FIG. 1 is an end view of the apparatus of the invention in accordance with one embodiment, positioned adjacent to a drilling rig or service rig.

FIG. 1 provides an end view of the apparatus of the invention, generally indicated by the reference numeral 10. In the Figures, the apparatus 10 is shown positioned adjacent to a drilling rig or service rig R having a rig floor RF, a hoist H, and pipe elevators PE suspended from hoist H. The apparatus 10 includes a base structure 12 which in the preferred embodiment will be mounted on a trailer chassis 11 to facilitate transportation of the apparatus between well sites. The apparatus 10 is adapted for use in conjunction with a loading rack 60 positioned along one side of the base structure 12 for storage of pipe sections P to be installed in a well, and an offload rack 62 for storage of pipe sections removed from a well.

Loading rack 60 and offload rack 62 may be independent assemblies, but preferably they are hingeingly attached to base structure 12 by suitable hinge means 66, such that the they can be folded against the sides of the base structure 12 when not in use, such as during transport. Loading rack 60 and offload rack 62 will preferably be fitted with manual or hydraulic jacks 64 or other suitable height-adjustment means whereby the loading rack 60 can be sloped so that pipes P will roll down loading rack 60 by gravity toward base structure 12, and will roll down offload rack 62 by gravity away from base structure 12. Offload rack 62 will be provided with suitable stop means 68 to prevent pipes P from rolling off.

In FIGS. 1-9, apparatus 10 is shown with both the loading rack 60 and offload rack 62 in position adjacent to base structure 12, but this is for illustrative purposes only. When running pipe into a well, it will only be necessary to use loading rack 60, such that offload rack 62 is not needed and may be stowed (or folded up, in the preferred embodiment). Similarly, only offload rack 62 needs to be deployed when pulling pipe P out of a well during tripping operations.

Figure 10:
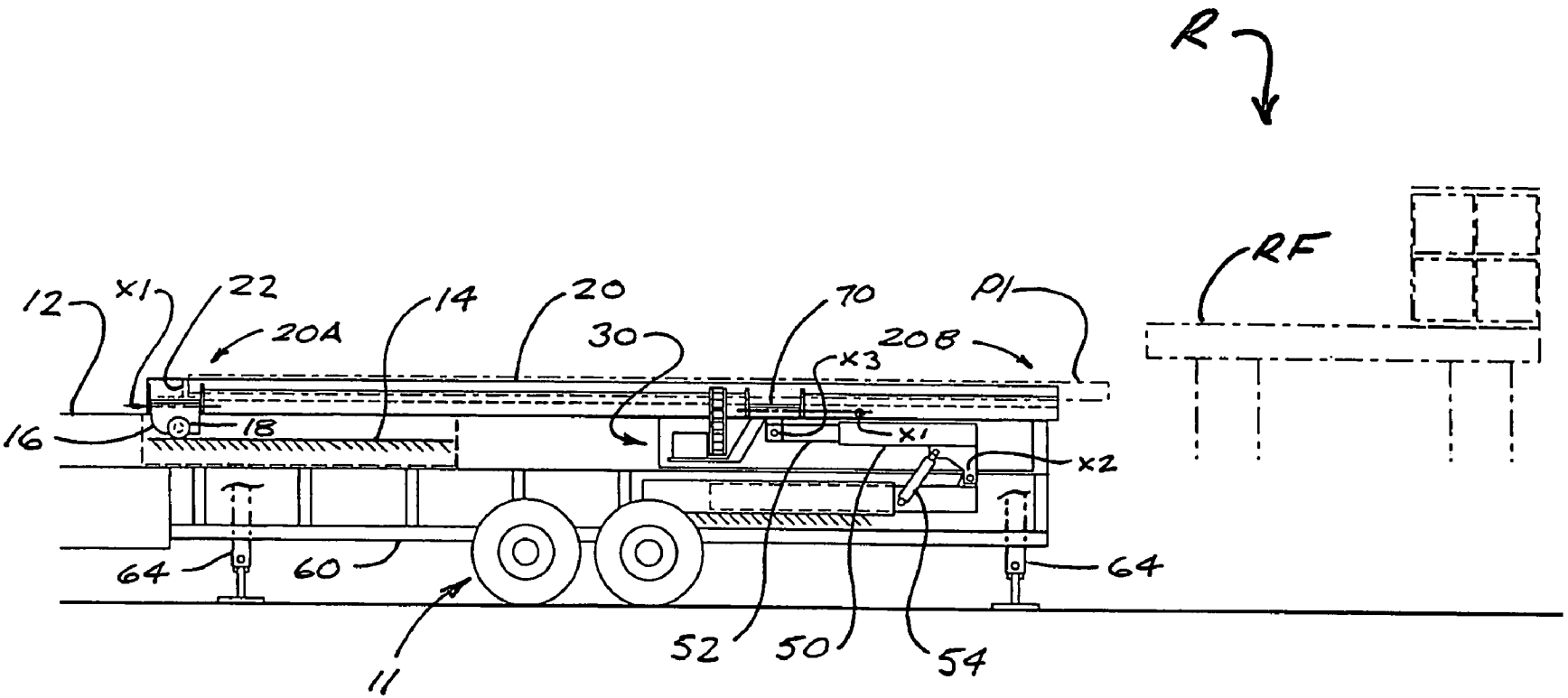
FIG. 10 is a longitudinal section through the apparatus along Line A-A in FIG. 1, showing the pipe cradle in the horizontal position, ready to lift a pipe to the floor of a drilling rig or service rig.

As illustrated in the Figures, apparatus 10 includes an elongate pipe cradle 20 having a trough 21 for receiving pipe sections that are to be run into a well or that have been pulled from a well. As shown in FIG. 10, pipe cradle 20 has an outward end 20A (i.e., the end farthest from rig R) and an inward end 20B. A pipe stop 22 of suitable construction (e.g., a steel plate or bracket) is disposed within trough 21 near outward end 20A of pipe cradle 20. As best seen in FIGS. 10-14, pipe cradle 20 is connected at its outward end 20A to a track carriage 16 adapted to move longitudinally along a base track 14 incorporated into base structure 12. Track carriage 16 and its connection to pipe cradle 20 are adapted such that outward end 20A of pipe cradle 20 can rotate about a substantially horizontal axis transverse to base track 14 as track carriage 16 moves along base track 14. In the embodiments shown in the Figures, this is achieved by provided track carriage 16 with rollers 18 that run within a base track 14 configured as a pair of spaced channel sections. However, it will be readily apparent to persons skilled in the field of the invention that this operational feature can be provided by a variety of other means. To provide only one example, track carriage 16 could have rotatably-mounted slide members that slide within channel sections in base track 14.

Figure 13:
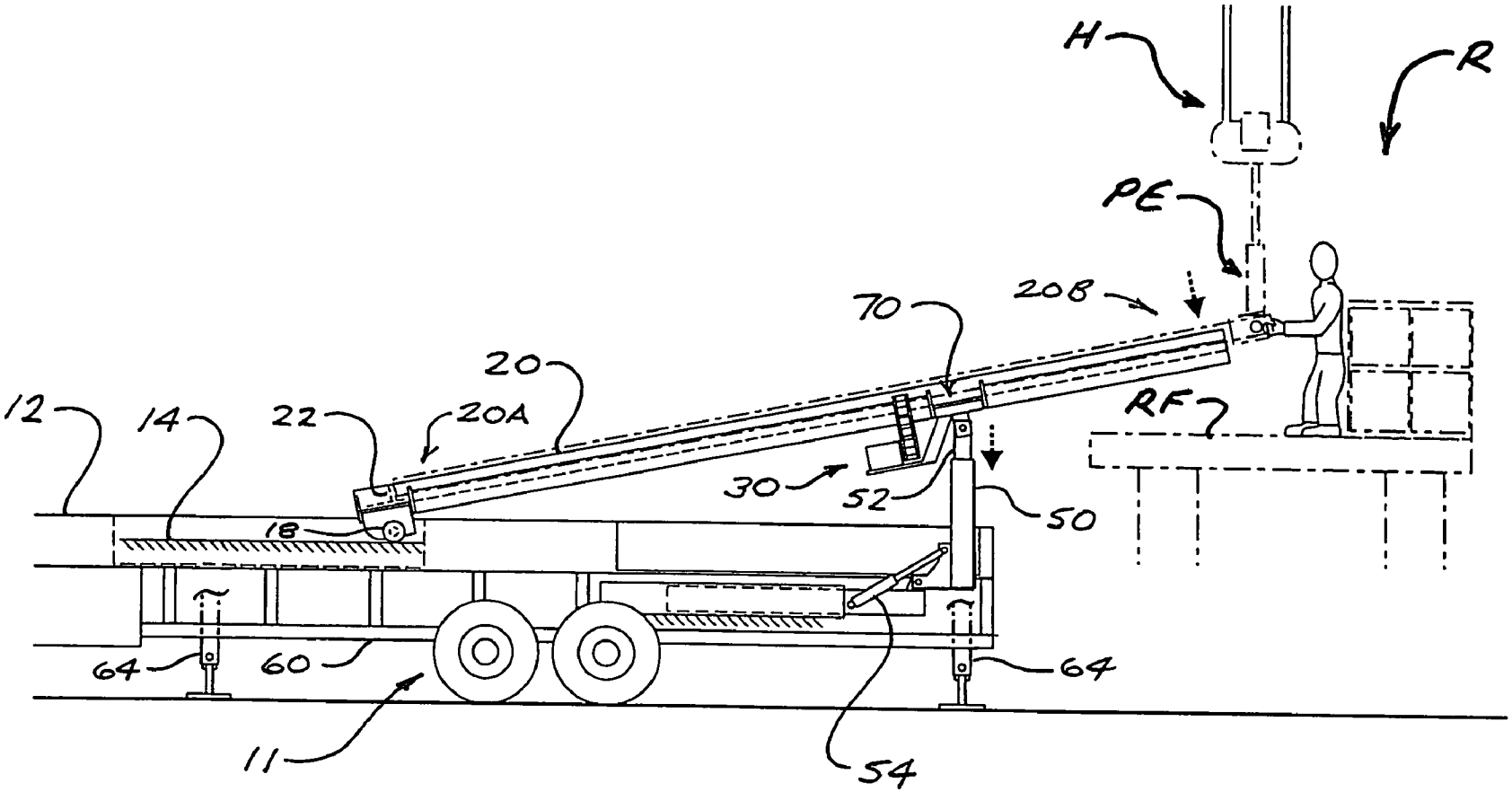
FIG. 13 is a longitudinal section showing the swing arm partially retracted so as to lower the pipe arm, with the pipe in the cradle being connected to the pipe elevators of the rig.
Figure 14:
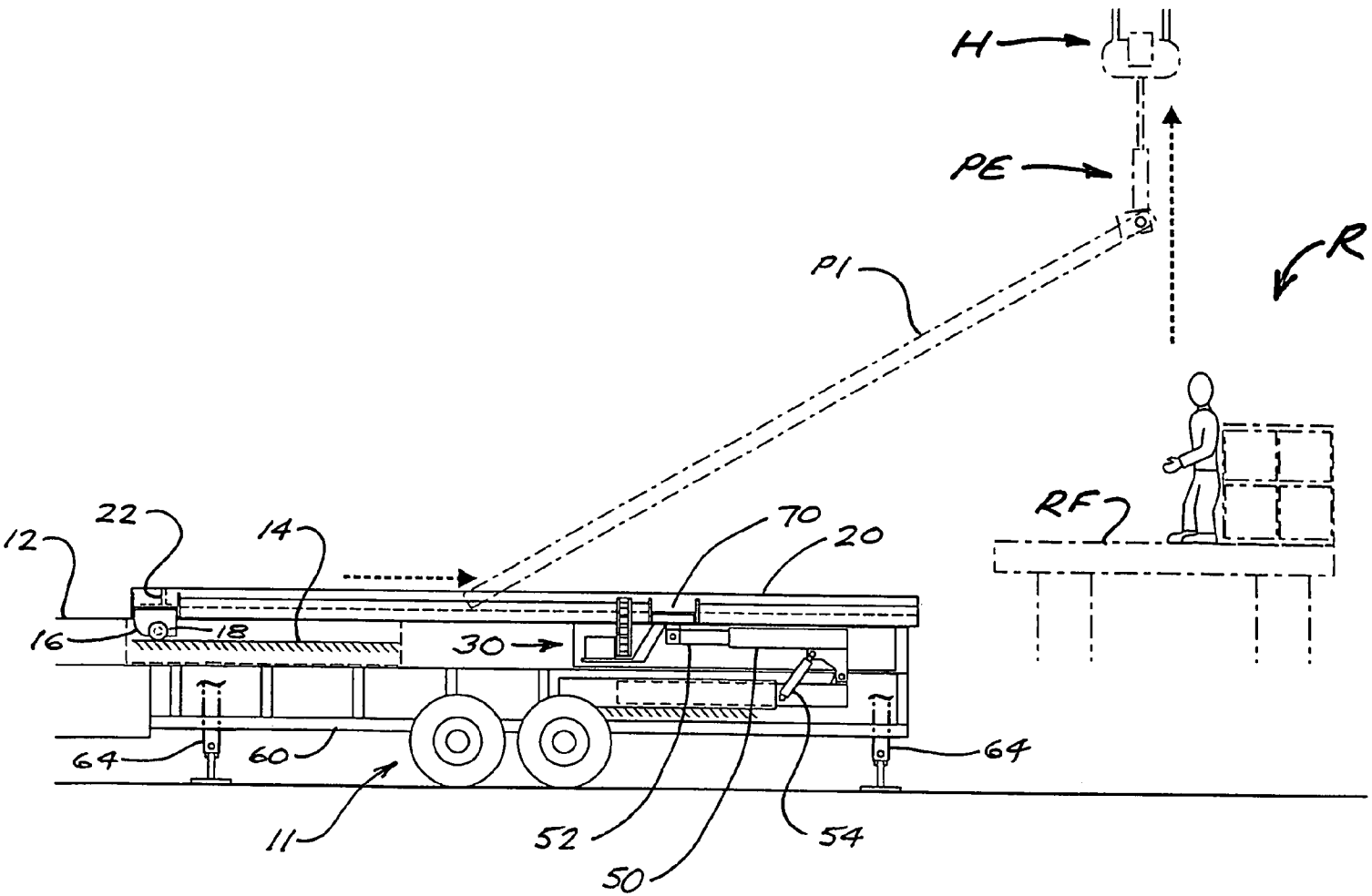
FIG. 14 is a longitudinal section showing the pipe cradle returned to the horizontal position, with the rig hoist lifting the pipe out of the cradle.
Figure 15:
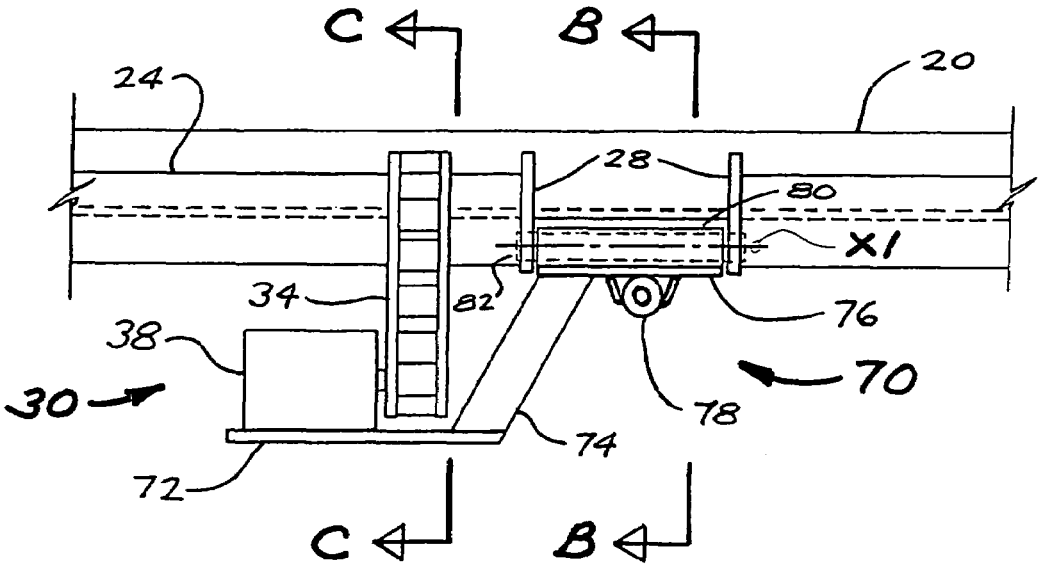
FIG. 15 is an elevational detail of the swivel means and upper swing arm connection in accordance with one embodiment of the invention.
Figure 16:
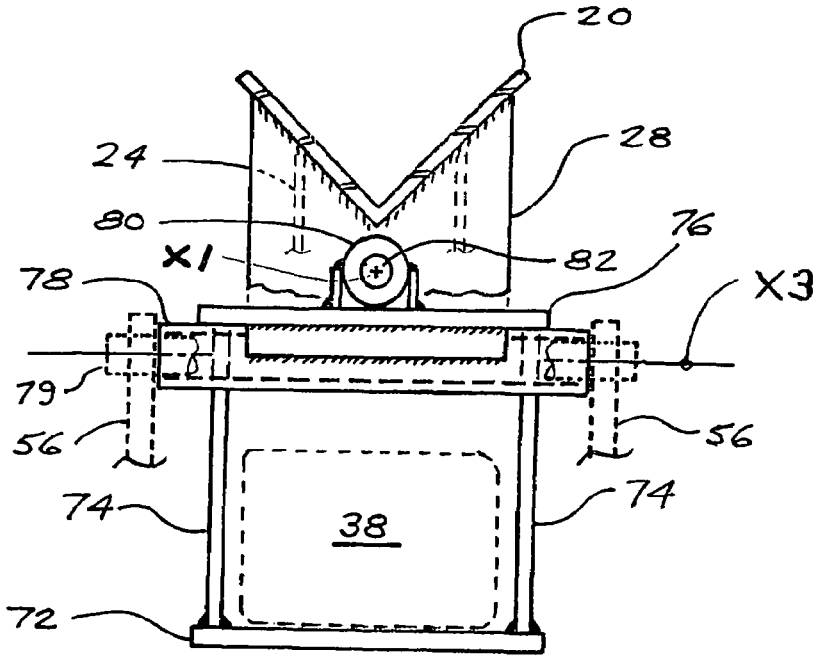
FIG. 16 is a cross-section along Line B-B in FIG. 15, illustrating the pipe cradle and upper swing arm connection in accordance with one embodiment.

The connection of track carriage 16 to pipe cradle 20 is also adapted such that pipe cradle 20 can swivel about a swivel axis X1 parallel to pipe cradle 20. As illustrated in FIGS. 10-14, apparatus 10 also has a swing arm 50 with its lower end 50A attached to base structure 12 so as to be rotatable about a horizontal transverse axis X2 relative to base structure 12. Upper end 50B of swing arm 50 is connected to pipe cradle 20 by means of a bi-directional hinge assembly 70 which allows upper end 50B to rotate about a horizontal transverse axis X3 passing through hinge assembly 70, while also allowing pipe cradle 20 to swivel about swivel axis X1. An exemplary embodiment of hinge connection 70 is illustrated in FIGS. 15 and 16, which will be described in detail further on in this specification. Persons skilled in the field of the invention will appreciate that features of hinge connection 70 as illustrated in FIGS. 15 and 16 can be readily adapted for incorporation into track carriage 16 to enable pipe cradle 20 to provide similar bi-directional rotatability.

Swing arm 50 is provided with swing arm actuating means for rotating swing arm 50 about transverse axis X2. In the preferred embodiment, the swing arm actuating means is provided in the form of a hydraulic lift cylinder 54 pivotably connected at one end to a fixed point on base structure 12 and at the other end to a selected point along the length of swing arm 50. As illustrated in FIGS. 10-14, lift cylinder 54 is configured so as to rotate swing arm 50 in the fashion of a third-class lever. However, other suitably effective configurations of lift cylinder 54, and other forms of swing actuating means, may be devised without departing from the principles of the present invention.

In the preferred embodiment, swing arm 50 has a telescoping or otherwise extensible and/or retractable auxiliary arm 52 whereby the overall length of swing arm 50 may be adjusted. Auxiliary arm 52 is preferably provided in the form of an auxiliary hydraulic cylinder. Also in the preferred embodiment (and as conceptually indicated in FIG. 17), swing arm 50 may be provided in the form of a frame having a pair of primary arms, each having a corresponding auxiliary arm 52. A suitable cross-member may be extended between the primary arms for connection to a single lift cylinder 54; alternatively, a lift cylinder 54 could be provided for each primary arm.

Apparatus 10 also includes swivel means 30 for swiveling pipe cradle 20 about a swivel axis X1 generally parallel to pipe cradle 20. In the preferred embodiment illustrated in FIGS. 15, 16, and 17, swivel means 30 comprises a cradle sprocket 32 which is notched to receive pipe cradle 20 as shown and which is rigidly fixed thereto such as by welding. A drive unit 38, such as a hydraulic motor, is supported on a motor bracket 72, which is rigidly suspended from a bushing support plate 76 by hanger plates 74 or other suitable means. A cylindrical swivel bushing 80 is mounted to the top of bushing support plate 76, and is disposed between a pair of spaced end plates 28 extending downward from pipe cradle 20. A swivel shaft 82 is concentrically disposed within swivel bushing 80 and is rotatably mounted at each end to the end plates 28, such that the axis of swivel shaft 82 (which will also be swivel axis X1) coincides with the rotational centerpoint of cradle sprocket 32. Drive unit 38 has a drive shaft 37 with a drive sprocket 36. A discontinuous drive chain 34 extends around cradle sprocket 32 and drive sprocket 36, and is fixed at each end to cradle sprocket 32 (such as by bolting or welding).

A cylindrical pivot bushing 78 is mounted to the lower side of bushing support plate 76, transverse to swivel bushing 80 as shown in FIGS. 15 and 16. A pivot shaft 79 (the centroidal axis of which is transverse axis X3, previously mentioned) is rotatably disposed within pivot bushing 78 and rotatably connected at each end to a suitable bearing bracket 56 associated with upper end 50B of swing arm 50 (as schematically indicated in broken lines in FIG. 16). Because motor bracket 72 is rigidly suspended from and laterally restrained by bushing support plate 76, which by virtue of its pivoting connection to swing arm 50 cannot rotate transversely, motor bracket 72 cannot rotate transversely either. Motor bracket 72 thus provides reaction means for resisting torque resulting upon activation of drive unit 38, which will therefore cause drive chain 34 to rotate cradle sprocket 32 and swivel pipe cradle 20 about swivel axis X1.

Figure 17:
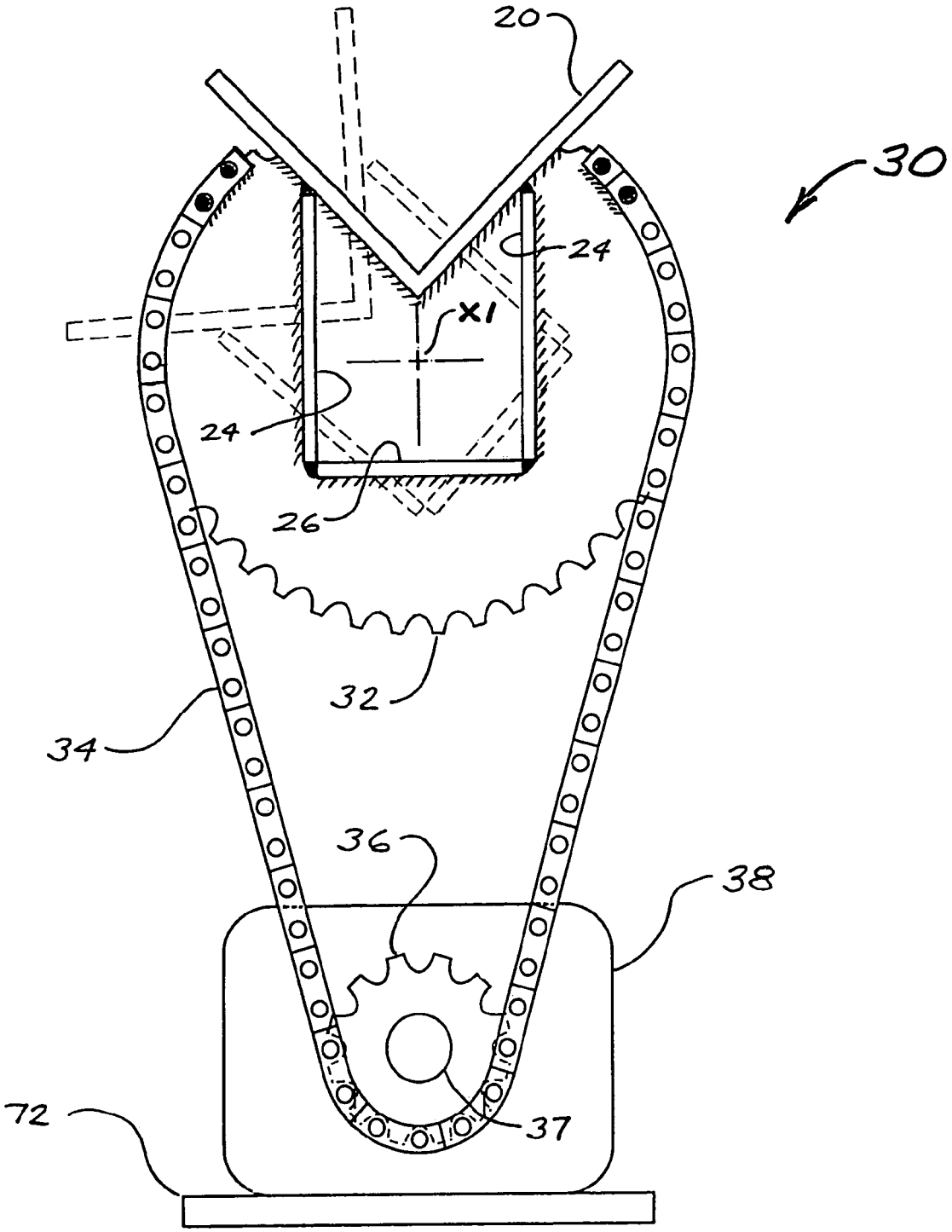
FIG. 17 is a cross-section along Line C-C in FIG. 15, illustrating the sprocket and drive assembly of the pivot means in accordance with one embodiment.

In the preferred embodiment, pipe cradle 20 will be selectively swivelable approximately 45 degrees either clockwise or counterclockwise (as shown in broken lines in FIG. 17).

As illustrated in FIG. 17, pipe cradle 20 is preferably in the form of an angle section, but this is not essential; pipe cradle 20 may have other cross-sectional configurations, as previously mentioned. As shown in detail in FIG. 17 (and generally in other Figures), pipe cradle 20 preferably has reinforcing plates 24 and 26 forming an elongate box structure. This or other forms of structural reinforcement may be desirable to increase the flexural and torsional strength and stiffness of pipe cradle 20. However, such reinforcement is not essential to the invention. For example, it may be feasible in some applications to obtain the required or desired structural properties by making pipe cradle 20 from a sufficiently heavy steel angle.

Figure 4:
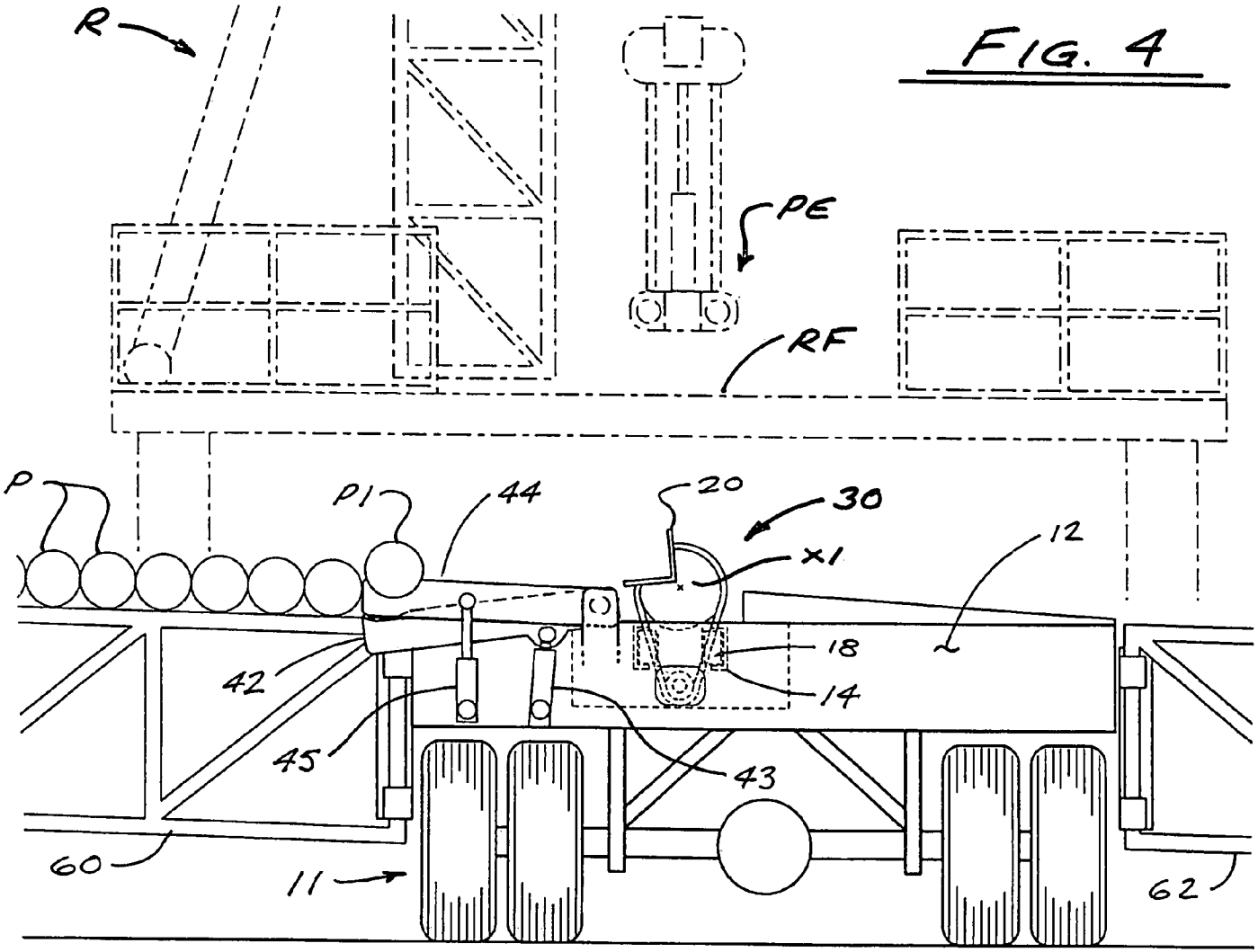
FIG. 4 is a cross-section showing the pipe-loading arms in the raised position, with a pipe from the loading rack positioned in the notches of the loading arms, with the ends of the pipe-loading arms restraining additional pipes on the loading rack.
Figure 5:
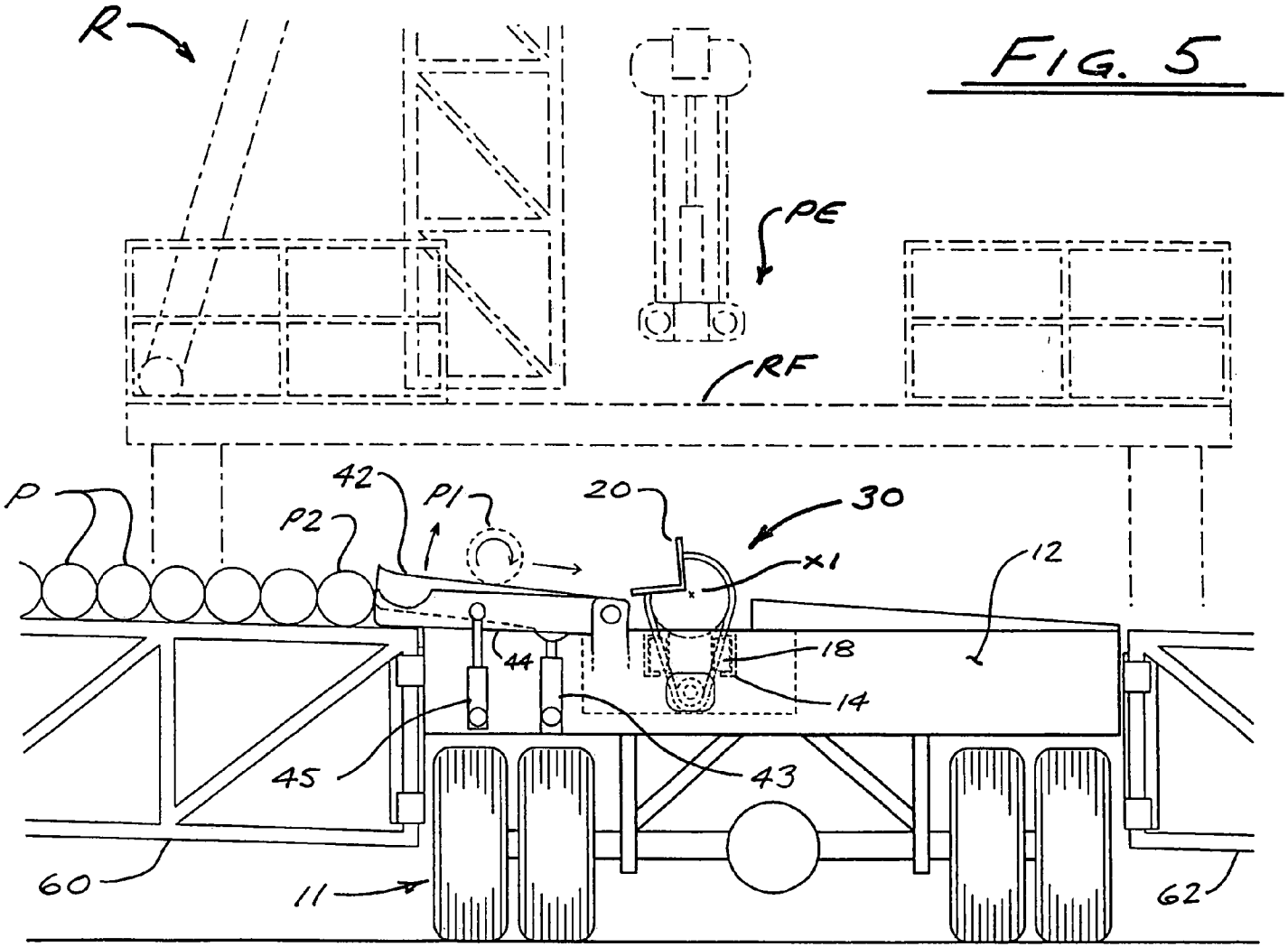
FIG. 5 is a cross-section showing the kicker members partially deployed and in the process of lifting the pipe out of the pipe-loading arms and directing it toward the cradle.
Figure 6:
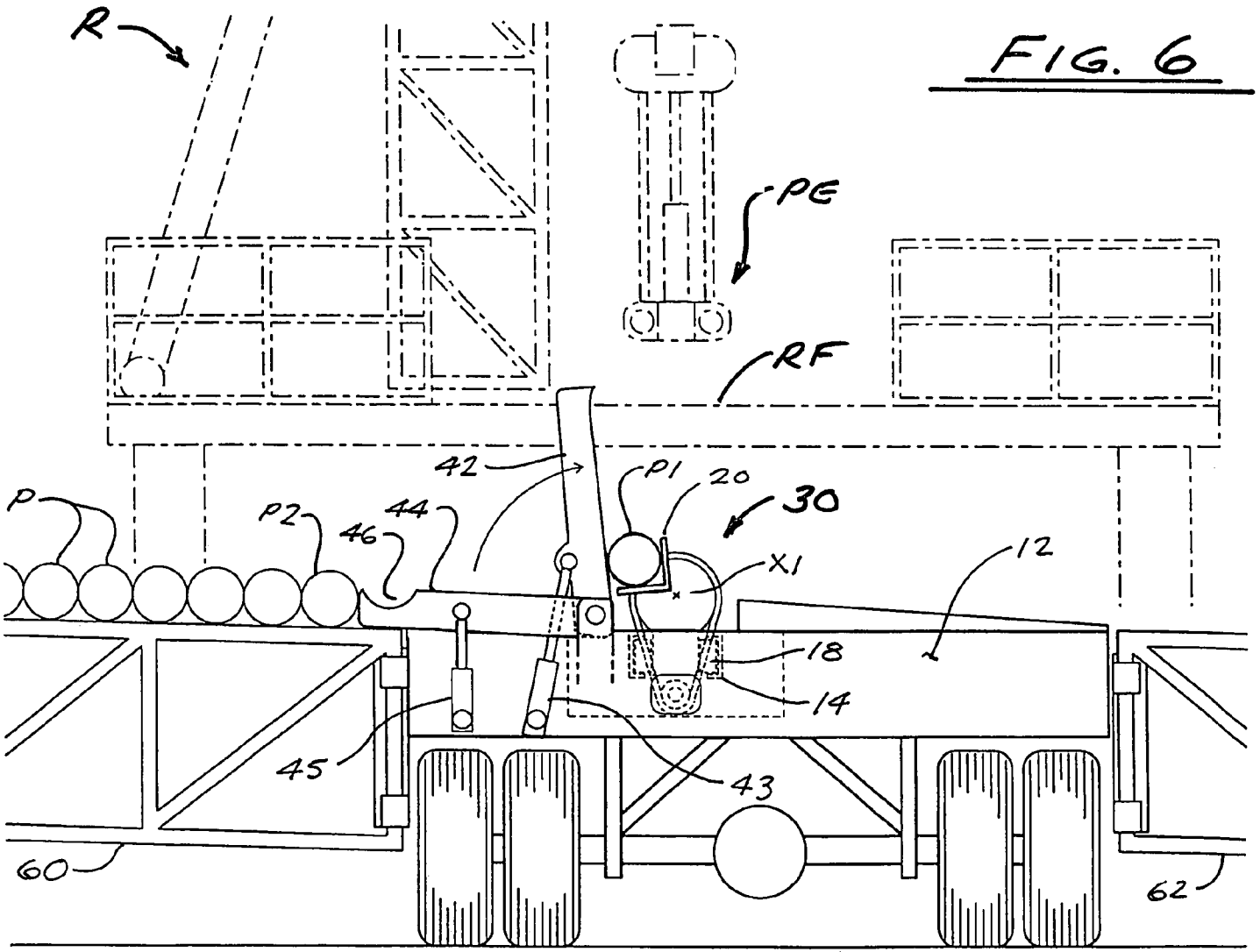
FIG. 6 is a cross-section showing the kicker members fully deployed and positioning the pipe in the cradle.

Referring now to FIGS. 2-9, apparatus 10 also includes cradle-loading means comprising at least two pipe-loading arms 44 and two kicker members 42. The loading arms 44 are spaced along the length of base structure 12, as are the kickers 42. In the preferred embodiment, each loading arm 44 is adjacent to a kicker 42, but this is not essential; kickers 42 may be spaced apart from loading arms 44. Each loading arm 44 is hingeingly connected to base structure 12 on the loading rack side of base track 14, and has an upwardly-oriented notch 46 near its outward end for receiving a pipe from loading rack 60. Loading arms 44 are operable between a lower position (best seen in FIG. 3) in which a pipe can freely roll off loading rack 60 into notches 46, and a raised position (as shown in FIG. 6, for example) in which loading arms 44 act as stoppers to prevent other pipe from rolling off rack 60. In the preferred embodiment, loading arms 44 are actuated by hydraulic cylinders 45 that move loading arms 44 in the fashion of a third-class lever. However, other means of actuation may be used without departing from the present invention.

The purpose of kicker members 42 is to dislodge a pipe out of notches 46 of loading arms 44 so as to move it into pipe cradle 20, and skilled workers will appreciate that kickers 42 may take various alternative forms to accomplish this purpose. In the preferred embodiment, however, each kicker 42 is an elongate arm that is hingeingly connected to base structure 12 on the loading rack side of base track 14. Kickers 42 are operable between a stowed position (best seen in FIG. 4) in which they cannot interfere with the loading of pipe from loading rack 60 onto loading arms 44), and a fully deployed position (as illustrated in FIG. 6). Kickers 42 in this embodiment may be actuated by hydraulic cylinders 43 in third-class lever fashion as shown in the Figures, but other actuation means are possible as well.

Figure 2:
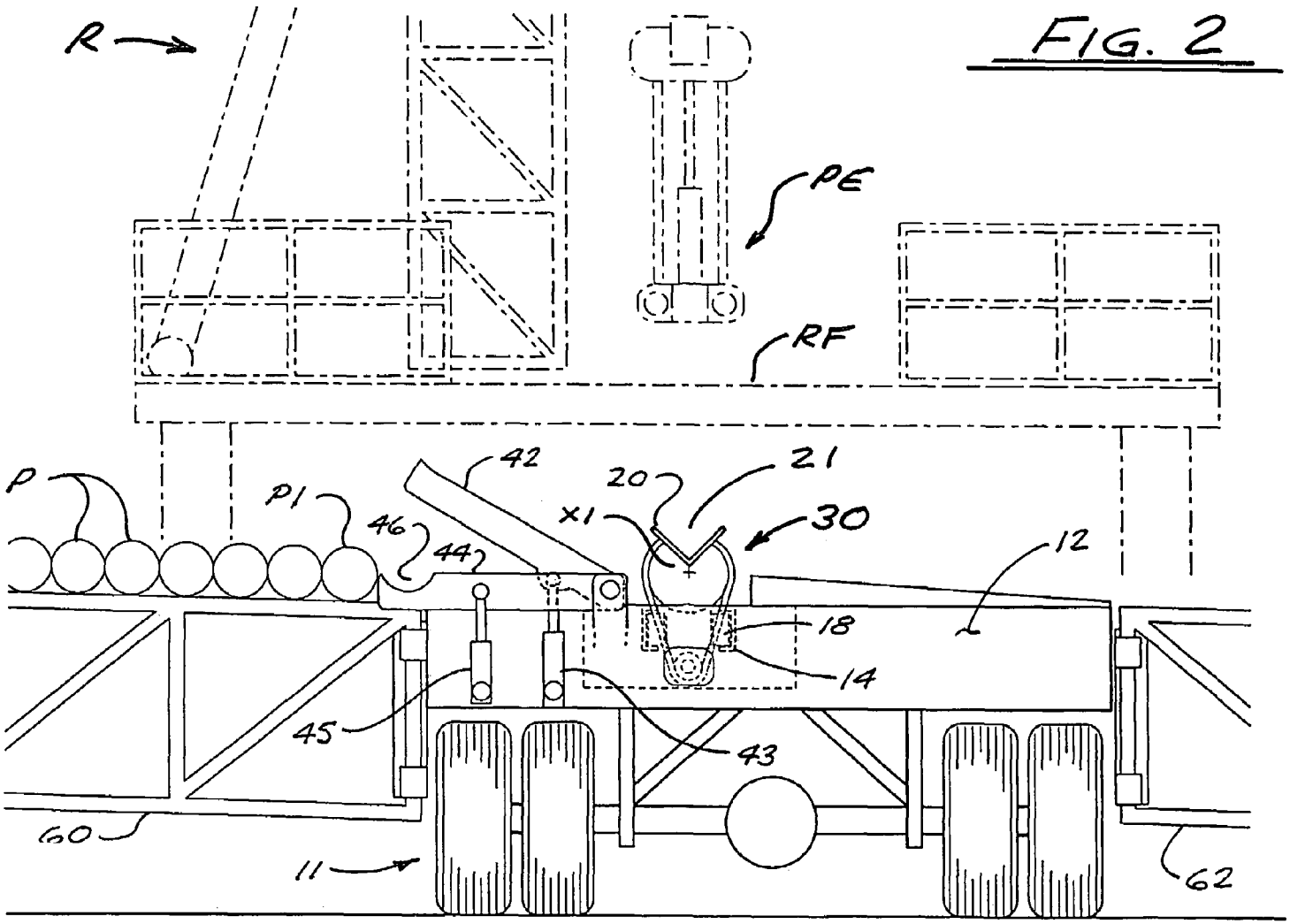
FIG. 2 is a cross-section through the apparatus showing the pipe cradle in the neutral position, lying in a horizontal position parallel to the base structure.
Figure 3:
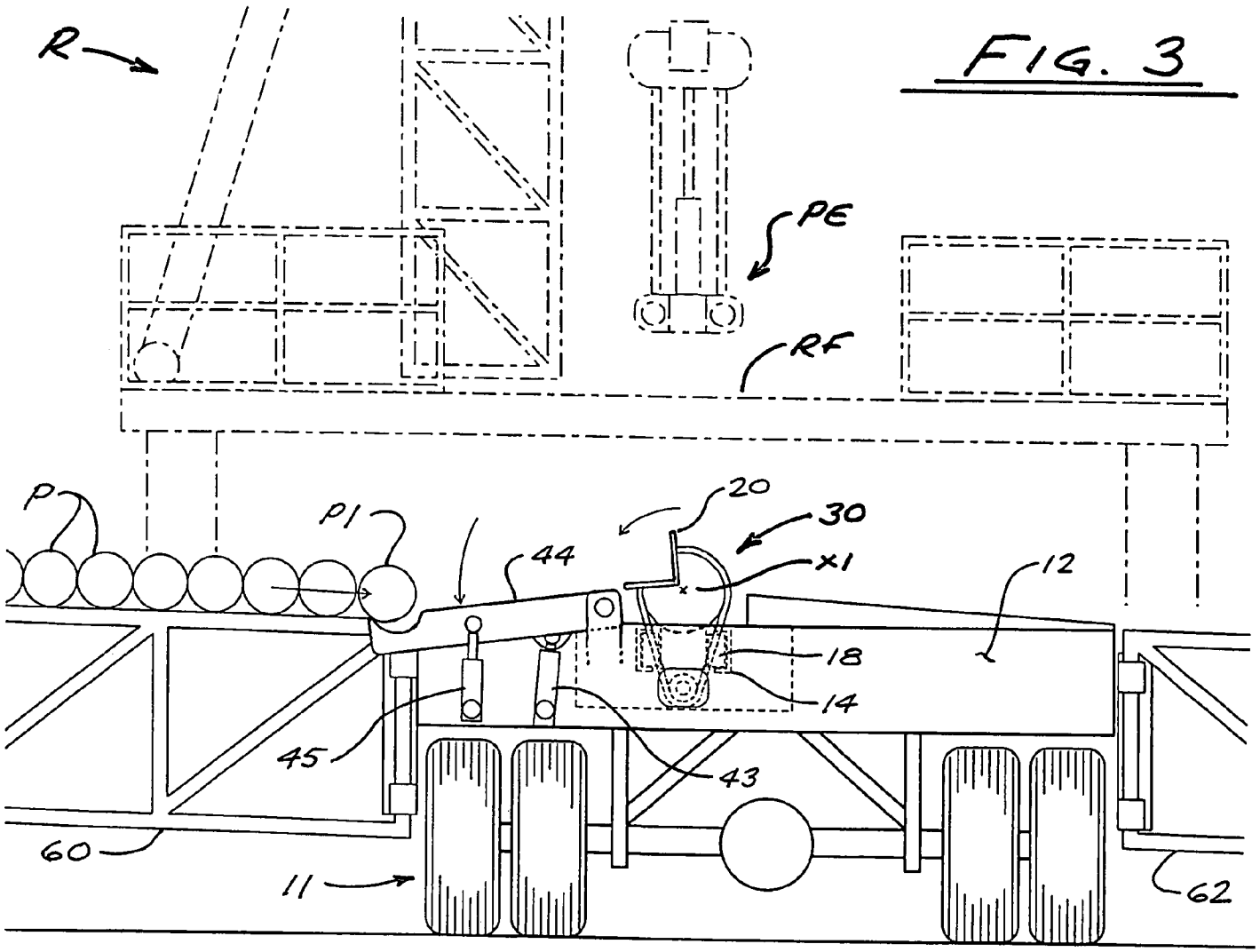
FIG. 3 is a cross-section showing the cradle swivelled into the loading position, with the pipe-loading arms in the lower position, ready to receive a pipe from the loading rack.

The operation of the apparatus 10 of the invention may now be readily understood with reference to the Figures. In FIGS. 2-9, pipe cradle 20 is lying in the horizontal position along base structure 12 (as also shown in FIG. 10). In FIG. 2, pipe cradle 20 is in the neutral position, with trough 21 oriented upward. Loading arms 44 are shown in the raised position in FIG. 2, such that they act as stoppers to prevent pipe sections P from rolling down loading rack 60. For illustrative purposes, kickers 42 are shown in a partly deployed position. To load a pipe section P1 from loading rack 60 using the apparatus 10, loading arms 44 are moved to the lower position as in FIG. 3, with kickers 42 (not shown in FIG. 3) in the stowed position. Pipe P1 is thus free to roll by gravity into notches 46 of loading arms 44. In preparation for receiving pipe section P1, swivel means 30 is actuated so as to swivel pipe cradle 20 into the loading position as illustrated in FIG. 3.

Figure 7:
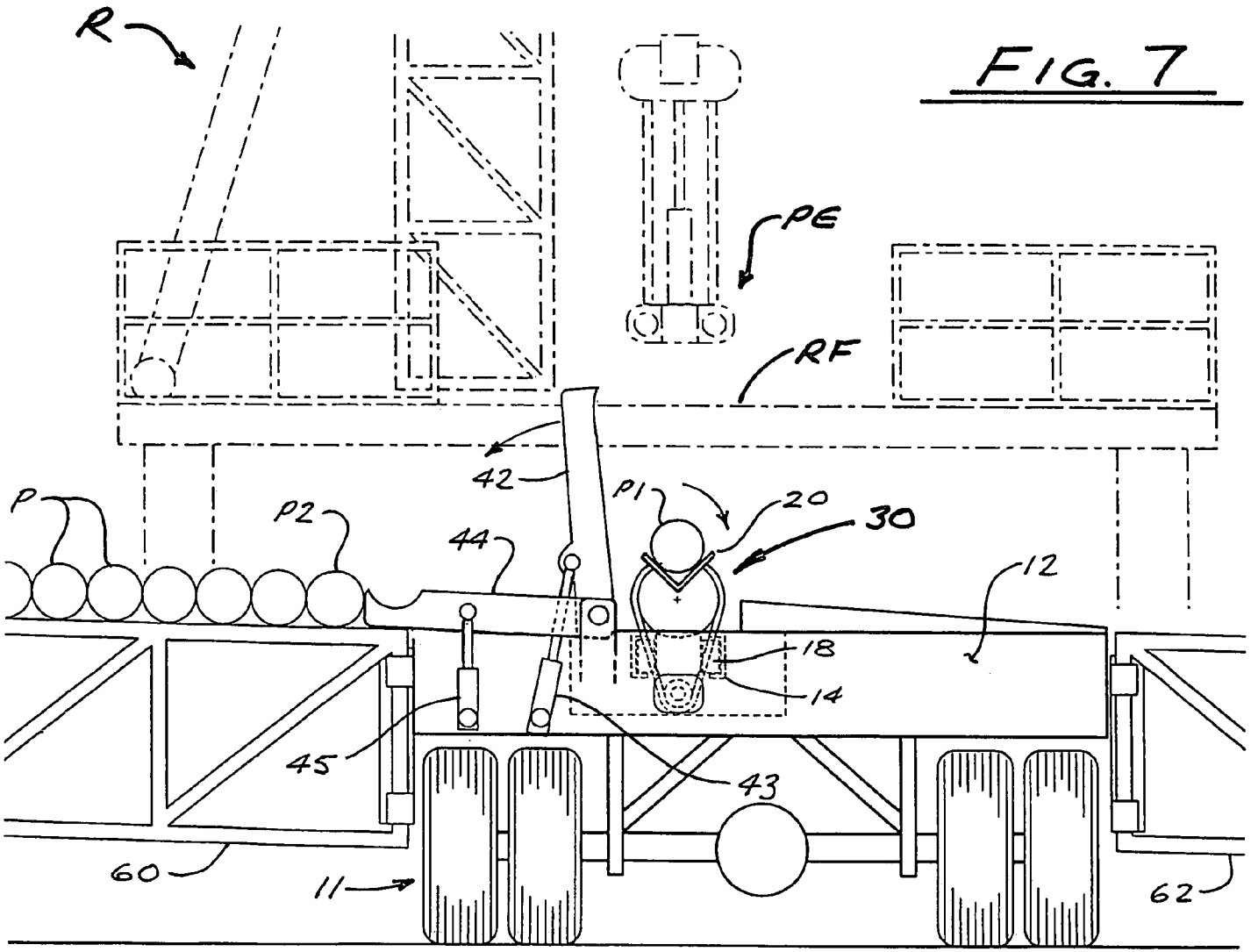
FIG. 7 is a cross-section showing the cradle swivelled back to the neutral position, with the pipe loaded therein.
Figure 8:
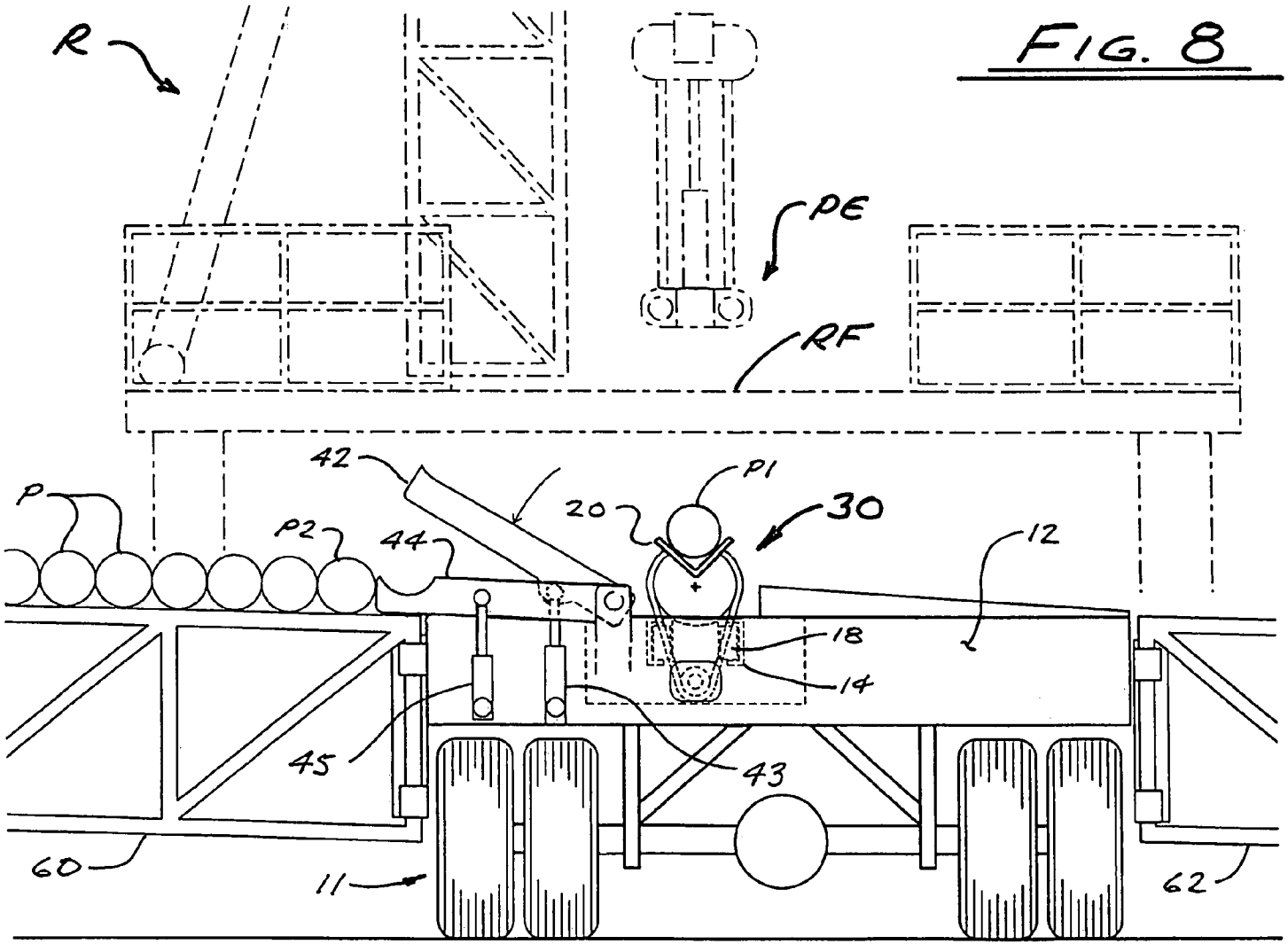
FIG. 8 is a cross-section showing the loaded pipe cradle in the neutral position, and the kicker arms returning to the stowed position.

Referring to FIG. 4, loading arms 44 are moved to the raised position, with pipe P1 supported in notches 46. Kickers 42 are then actuated to lift pipe P1 out of notches 46 and direct it toward pipe cradle 20. FIG. 5 shows kickers 42 at a point where they have been raised slightly above horizontal so that pipe P1 has started to roll along kickers 42 by gravity toward pipe cradle 20. FIG. 6 shows kickers 42 in the fully deployed position, pushing pipe P1 into trough 21 of pipe cradle 20. As shown in FIGS. 7 and 8, pipe cradle 20 is then swiveled back to the neutral position, whereupon kickers 42 can begin moving back toward the stowed position.

Figure 11:
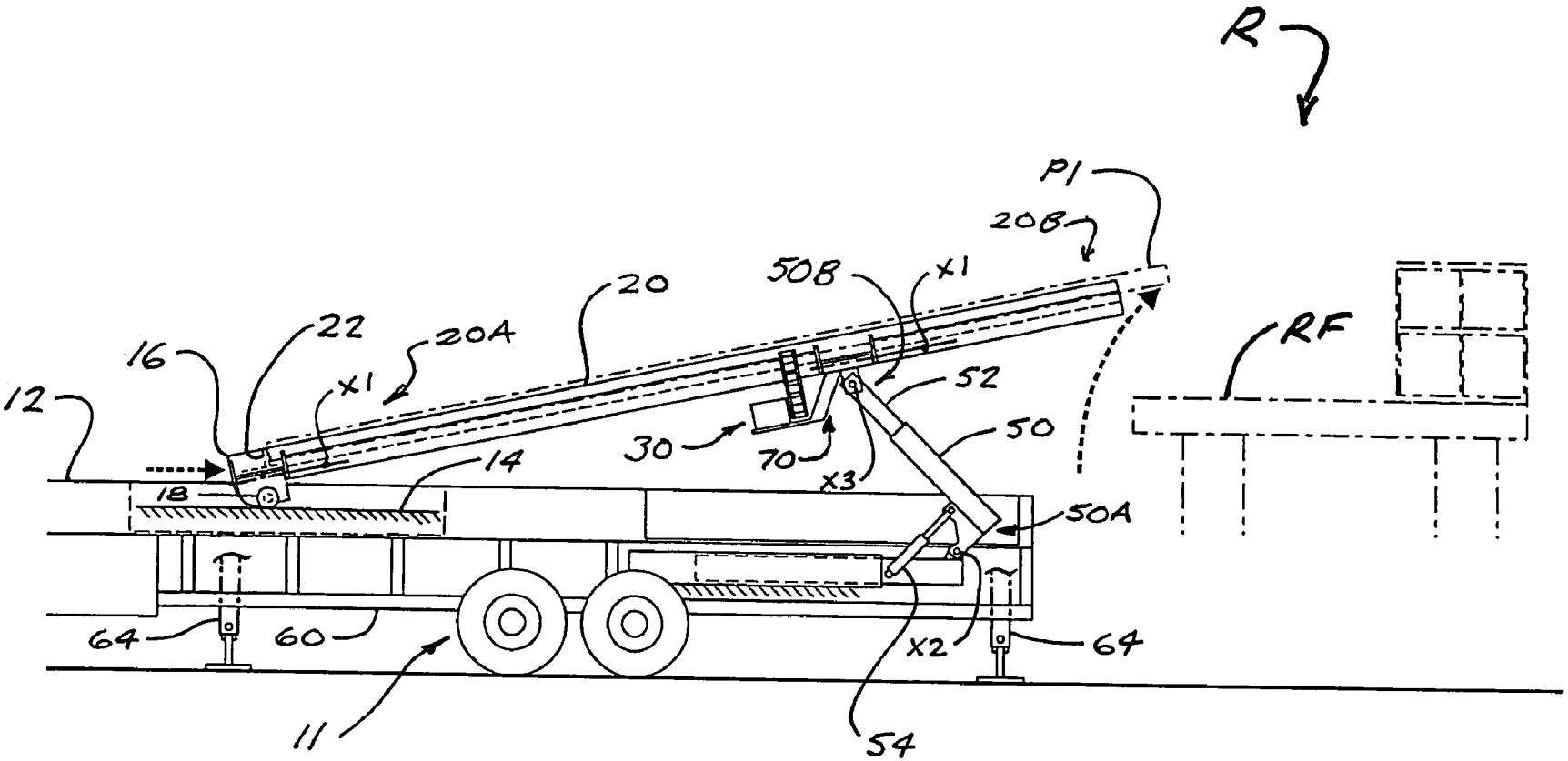
FIG. 11 is a longitudinal section showing the swing arm partially rotated so as to move the inner end of the pipe arm toward the rig floor.

FIGS. 10-14 illustrate how a pipe P1, having been loaded in pipe cradle 20, can then be delivered to rig R using the apparatus 10 of the invention. Lift cylinder 54 is actuated to rotate swing arm 50 about transverse axis X2, as shown in FIG. 11. This causes upper end SOB of swing arm 50, by virtue of its rotatable connection to pipe cradle 20, to raise the inward end of pipe cradle 20 and draw it toward rig R, at the same time drawing track carriage 16 toward rig R along base track 14.

Figure 12:
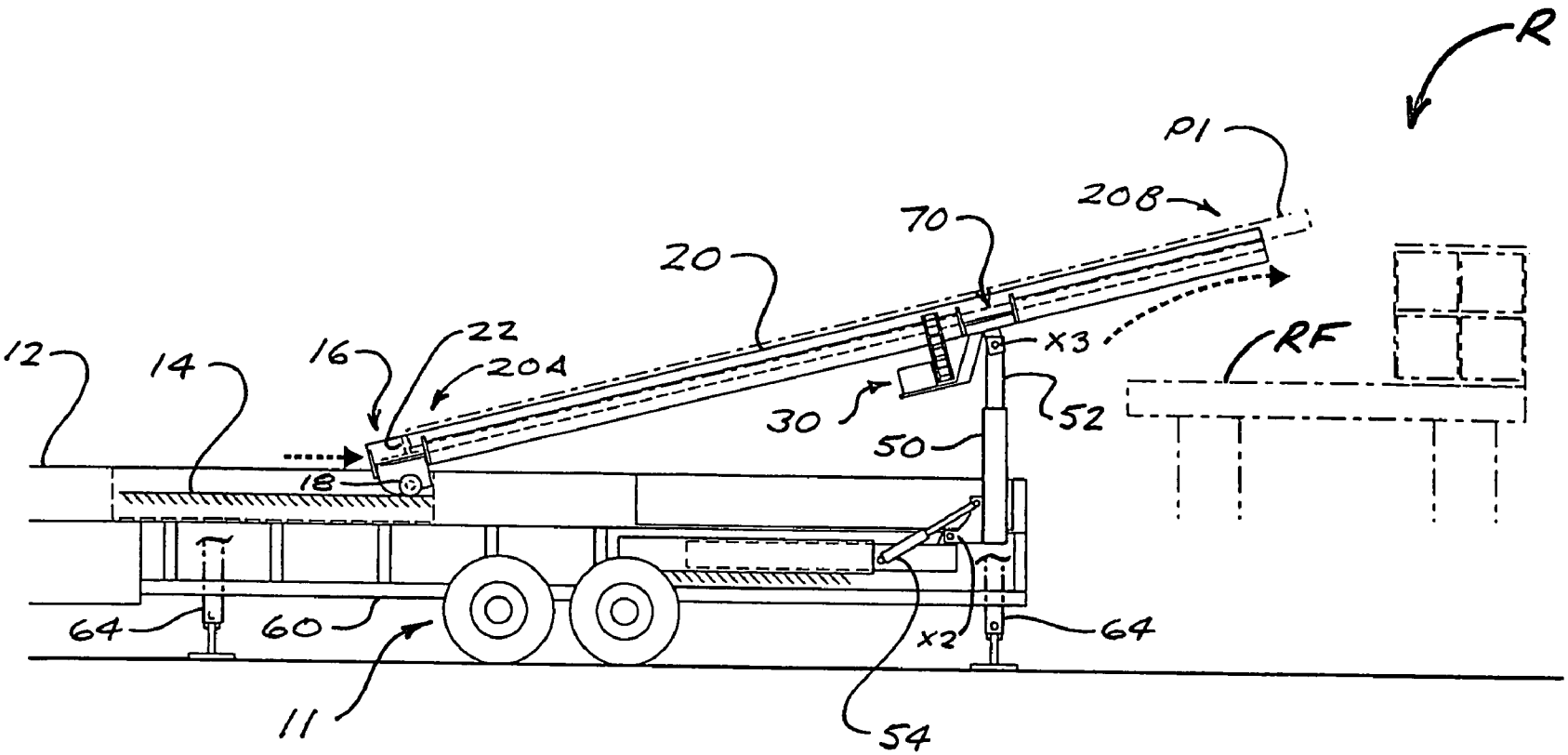
FIG. 12 is a longitudinal section showing the swing arm extended and rotated to vertical, with the inner end of the pipe arm above the rig floor.

In FIG. 12, swing arm 50 has been rotated to the vertical position. Inward end 20B of pipe cradle 20 and pipe P1 are disposed at a point above rig floor RF. In FIG. 13, a worker is shown connecting the inward end of pipe P1 to pipe elevators PE. FIG. 13 also schematically illustrates how the telescoping auxiliary arm 52 of the preferred embodiment may be used to adjust the height of pipe cradle 20 to facilitate connection of pipe P1 to pipe elevators PE. Hoist H of rig R may then be actuated, as shown in FIG. 14, to lift pipe P1 out of pipe cradle 20 so that it can be added to the drill string or production string being made up in the operation. Lift cylinder 54 may then be actuated to rotate swing arm 50 so as to restore pipe cradle 20 to the horizontal position, whereupon the process is repeated to load the next pipe section from loading rack 60.

Further inward movement of the pipe relative to the structure 12 can be made possible by adapting swing arm 50 to rotate beyond the vertical position toward rig R. Such additional rotation will result in a lowering of the inward end of pipe cradle 20, but this can be compensated for as necessary by adjusting the length of auxiliary arm 52.

Figure 9:
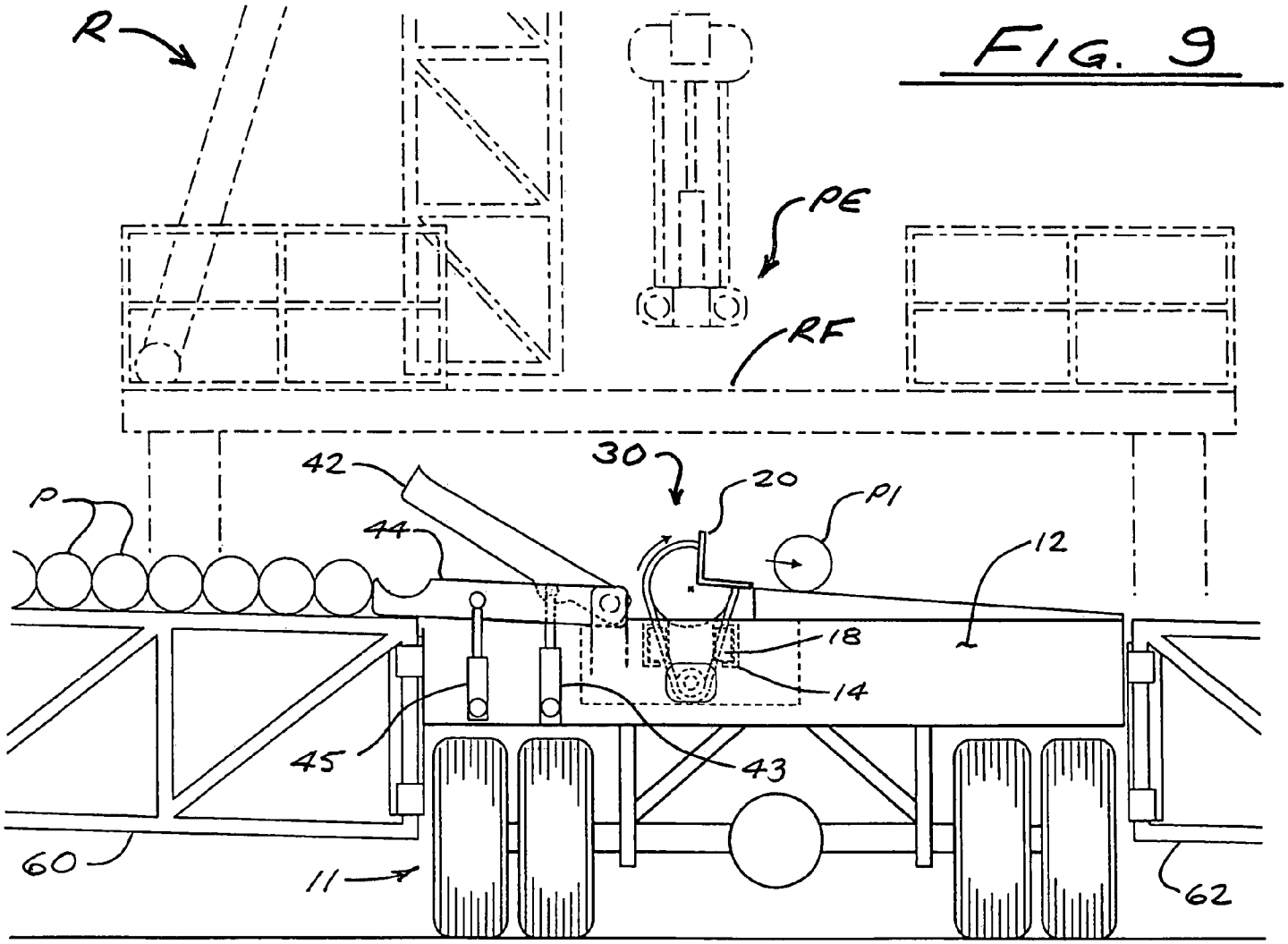
FIG. 9 is a cross-section showing the cradle swivelled into the offloading position, with a pipe rolling out of the cradle onto the offload rack.

The apparatus 10 may also be used to handle pipe sections removed from a well during tripping operations, by carrying out the above-described steps in reverse order. With pipe cradle 20 in an elevated configuration similar to that shown in FIG. 13, the lower end of a pipe P1 suspended from hoist H is positioned in trough 21 of pipe cradle 20 near its inner end 20B. Hoist H then lowers pipe P1 such that its lower end will slide down pipe cradle 20 until it rests in trough 21 of pipe cradle 20, generally as shown in FIG. 13, whereupon workers may then disconnect pipe P1 from pipe elevators PE. Lift cylinder 54 is then be actuated to rotate swing arm 50 so as to restore pipe cradle 20 to the horizontal position, generally as shown in FIG. 10. Next, swivel means 30 is actuated so as to swivel the pipe cradle 20 into the offloading position as shown in FIG. 9, such that pipe P1 may simply roll out of pipe cradle 20 by gravity and onto offload rack 62. This procedure is then repeated for the next pipe section to be removed from the well.

It will be readily seen by those skilled in the art that various modifications of the present invention may be devised without departing from the essential concept of the invention, and all such modifications are intended to be included in the scope of the claims appended hereto.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A pipe-handling apparatus, for transporting pipe sections to or from a rig floor, said apparatus comprising:

(a) a base structure having an elongate horizontal base track, said base track having an inward end and an outward end;

(b) a track carriage, said track carriage being longitudinally movable along the base track;

(c) an elongate pipe cradle having an inward end and an outward end, said pipe cradle:

c.1 defining a trough for receiving a pipe section; and c.2 being mounted near its outward end to the track carriage so as to be swivelable relative to the track carriage about a cradle swivel axis substantially parallel to, and in a fixed relationship with, the pipe cradle; and c.3 being pivotable relative to the track carriage about a substantially horizontal cradle pivot axis associated with the track carriage and oriented transverse to the base track;

(d) swivel means, for swiveling the pipe cradle about the cradle swivel axis, said swivel means being:

d.1 rigidly mounted to an underside of the pipe cradle at a selected point along the pipe cradle; and d.2 operable to move the pipe cradle between a neutral position and a loading position;

and comprising:

d.3 a cradle sprocket disposed below and fixedly mounted to the pipe cradle, said cradle sprocket being notched to receive the pipe cradle and having a circular gear section concentric with the cradle swivel axis;

d.4 a drive unit disposed below the pipe cradle and mounted to the lift means, said drive unit having a rotatable drive shaft with an axis substantially parallel to the cradle;

d.5 a drive sprocket mounted to the drive shaft; and d.6 a discontinuous drive chain disposed around the drive sprocket and connected at each end to the cradle sprocket such that rotation of the drive shaft will cause the pipe cradle to swivel about the cradle swivel axis;

(e) a swing arm having a lower end and an upper end, wherein:

e.1 said lower end is mounted to the base structure so as to be pivotable relative thereto about a first swing arm pivot axis, said first swing arm pivot axis being associated with the base structure and being oriented horizontally transverse to the base track;

e.2 said upper end is mounted to the swivel means so as to be pivotable relative thereto about a second swing arm pivot axis, said second swing arm pivot axis being associated with the swivel means and being parallel to said first swing arm pivot axis, such that the pipe cradle is swivelable, relative to the upper end of the swing arm, about the cradle swivel axis; and e.3 when the swing arm is in a substantially horizontal position, said second swing arm pivot axis will lie between the first swing arm pivot axis and the outward end of the pipe cradle; and (f) swing arm actuating means, for pivoting the swing arm about the first swing arm pivot axis so as to selectively:

f.1 raise the inward end of the pipe cradle to an elevated position above the horizontal base track, thereby concurrently pivoting the pipe cradle in a first direction about said cradle pivot axis and causing the track carriage and the outward end of the cradle to move horizontally along the base track toward the inward end thereof; and f.2 lower the inward end of the pipe cradle from an elevated position above the horizontal base track, thereby concurrently pivoting the pipe cradle in a second direction about said cradle pivot axis and causing the track carriage and the outward end of the cradle to move horizontally along the base track toward the outward end thereof.

2. The apparatus of claim 1 wherein the track carriage is slidingly movable along the base track.

3. The apparatus of claim 1 wherein the track carriage comprises rolling means whereby the track carriage is rolling movable along the base track.

4. The apparatus of claim 1 wherein the trough is V-shaped in cross-section.

5. The apparatus of claim 1 wherein the trough is curvilinear in cross-section.

6. The apparatus of claim 1 wherein the swing arm actuating means comprises a hydraulic cylinder connected between the base structure and a point along the length of the swing arm.

7. The apparatus of claim 1 wherein the swing arm is variable in length.

8. The apparatus of claim 7, further comprising a hydraulic cylinder for varying the length of the swing arm.

9. The apparatus claim 1 wherein the drive unit is hydraulically actuated.

10. The apparatus of claim 1 wherein the drive unit is electrically actuated.

11. The apparatus of claim 1, further comprising cradle-loading means, for receiving a pipe section from a loading rack and loading the pipe section into the pipe cradle.

12. The apparatus of claim 11 wherein the cradle-loading means comprises:

(a) a plurality of pipe-loading arms oriented transversely and adjacent to the pipe cradle, each pipe-loading arm having an upwardly-disposed notch adapted to receive a pipe section, said pipe-loading arms being operable between a lower position in which a pipe section may be readily rolled from the loading rack into the notches of the pipe-loading arms, and a raised position in which the pipe-loading arms prevent additional pipes from rolling off the loading rack; and (b) a plurality of kicker members, said kicker members being operable between a stowed position below the notches in the pipe-loading arms, and a deployed position whereby the kicker members can move a pipe section from the pipe-loading arms into the Pipe cradle when the pipe cradle is in the loading position.

13. The apparatus of claim 12 wherein each pipe-loading arm is pivotable about an axis substantially parallel to the base track.

14. The apparatus of claim 1 wherein the swivel means is also operable to orient the pipe cradle in an offloading position such that a pipe section can roll out of the cradle to an offload rack.

15. The apparatus of claim 1, further comprising a loading rack and an offload rack hingeingly connected to either side of the base structure, said loading rack and offload rack being individually movable between a stowed position folded against the base structure, and a deployed position.

16. The apparatus of claim 15, further comprising jacking means for adjusting the slope of the loading rack and the offload rack when in the deployed position.

17. The apparatus of claim 1, further comprising cradle-loading means, for loading a pipe from a loading rack into the cradle.

18. The apparatus of claim 17 wherein the cradle-loading means comprises:

(a) a plurality of pipe-loading arms oriented transversely and adjacent to the pipe cradle, each pipe-loading arm having an upwardly-disposed notch adapted to receive a pipe section, said pipe-loading arms being operable between lower position in which a pipe section may be readily rolled from the loading rack into the notches of the pipe-loading arms, and a raised position in which the pipe-loading arms prevent additional pipes from rolling off the loading rack; and (b) a plurality of kicker members, said kicker members being operable between a stowed position below the notches in the pipe-loading arms, and a deployed position whereby the kicker members can move a pipe section from the pipe-loading arms into the pipe cradle when the pipe cradle is in the loading position.

19. A pipe-handling apparatus, for transporting pipe sections to or from a rig floor, said apparatus comprising:

(a) a base structure having an elongate horizontal base track, said base track having an inward end and an outward end;

(b) a track carriage, said track carriage being longitudinally movable along the base track;

(c) an elongate pipe cradle haying an inward end and an outward end, said pipe cradle:

c.1 defining a trough for receiving a pipe section; and c.2 being mounted near its outward end to the track carriage so as to be swivelable relative to the track carriage about a cradle swivel axis substantially parallel to, and in a fixed relationship with, the pipe cradle; and c.3 being pivotable relative to the track carriage about a substantially horizontal cradle pivot axis associated with the track carriage, and oriented transverse to the base track;

(d) a swivel mechanism, for swiveling the pipe cradle about the cradle swivel axis between a neutral position and a loading position, said swivel means being mounted to an underside of the pipe cradle at a selected point along the pipe cradle, and comprising:

d.1 a cradle sprocket disposed below and fixedly mounted to the pipe cradle, said cradle sprocket being notched to receive the pipe cradle and having a circular gear section concentric with the cradle swivel axis;

d.2 a drive unit disposed below the pipe cradle and mounted to the lift means, said drive unit having a rotatable drive shaft with an axis substantially parallel to the cradle;

d.3 a drive sprocket mounted to the drive shaft; and d.4 a discontinuous drive chain disposed around the drive sprocket and connected at each end to the cradle sprocket such that rotation of the drive shaft will cause the pipe cradle to swivel about the cradle swivel axis;

(e) a swing arm having a lower end and an upper end, wherein:

e.1 said lower end is mounted to the base structure so as to be pivotable relative thereto about a first swing arm pivot axis, said first swing arm pivot axis being associated with the base structure and being oriented horizontally transverse to the base track;

e.2 said upper end is mounted to the swivel means so as to be pivotable relative thereto about a second swing arm pivot axis, said second swing arm pivot axis being associated with the swivel means and being parallel to said first swing arm pivot axis; such that the pipe cradle is swivelable, relative to the upper end of the swing arm, about the cradle swivel axis; and e.3 when the swing arm is in a substantially horizontal position, said second swing arm pivot axis will lie between the first swing arm pivot axis and the outward end of the pipe cradle; and (f) swing, arm actuating means, for pivoting the swing arm about the first swing arm pivot axis so as to selectively:

f.1 raise the inward end of the pipe cradle to an elevated position above the horizontal base track, thereby concurrently pivoting the pipe cradle in a first direction about said cradle pivot axis and causing the track carriage and the outward end of the cradle to move horizontally along the base track toward the inward end thereof; and f.2 lower the inward end of the pipe cradle from an elevated position above the horizontal base track, thereby concurrently pivoting the pipe cradle in a second direction about said cradle pivot axis and causing the track carriage and the outward end of the cradle to move horizontally along the base track toward the outward end thereof.

* * * * *